US006986801B2

(12) United States Patent
Ibaraki et al.

(10) Patent No.: US 6,986,801 B2
(45) Date of Patent: Jan. 17, 2006

(54) METHOD OF PRODUCING REDUCED IRON COMPACTS IN ROTARY HEARTH-TYPE REDUCING FURNACE, REDUCED IRON COMPACTS, AND METHOD OF PRODUCING MOLTEN IRON USING THEM

(75) Inventors: Tetsuharu Ibaraki, Kimitsu (JP); Shouji Imura, Kimitsu (JP); Hiroshi Oda, Kimitsu (JP); Masaharu Takahashi, Kimitsu (JP); Yoichi Abe, Futtsu (JP); Shigeki Takahashi, Futtsu (JP); Satoshi Suzuki, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 84 days.

(21) Appl. No.: 10/243,549

(22) Filed: Sep. 13, 2002

(65) Prior Publication Data

US 2003/0089200 A1 May 15, 2003

(30) Foreign Application Priority Data

Sep. 14, 2001 (JP) ..... 2001-279056

(51) Int. Cl.
*C21B 13/08* (2006.01)

(52) U.S. Cl. ..... 75/484; 420/590

(58) Field of Classification Search ..... 75/484; 420/590

See application file for complete search history.

(56) References Cited

U.S. PATENT DOCUMENTS 3,645,717 A * 2/1972 Meyer et al. ..... 75/479

FOREIGN PATENT DOCUMENTS

| | | |
|---|---|---|
| JP | 9-279258 | 10/1997 |
| JP | 10-192894 | 7/1998 |
| JP | 11-61217 | 3/1999 |
| JP | 11-92833 | 4/1999 |
| JP | 11-241125 | 9/1999 |
| JP | 2000-34526 | 2/2000 |
| JP | 2000-54034 | 2/2000 |
| JP | 2000-119722 | 4/2000 |
| JP | 2000-212651 | 8/2000 |
| JP | 2000-239752 | 9/2000 |
| JP | 2001-234256 | 8/2001 |
| JP | 2002-194410 | 7/2002 |
| WO | WO 01/42516 A1 | 6/2001 |

OTHER PUBLICATIONS

Notice of Reasons for Rejection English Translation Sep. 14, 2004 Japanese Patent App No. 2001–269794.
Notice of Reasons for Rejection English Translation Sep. 14, 2004 Japanese Patent App No. 2001–279056.

* cited by examiner

*Primary Examiner*—Melvyn Andrews
(74) *Attorney, Agent, or Firm*—Kenyon & Kenyon

(57) ABSTRACT

There is provided a method of producing reduced iron compacts with high crushing strength, low powderization and a high reduction rate in a solid reduction-type firing reducing furnace such as a rotary hearth-type reducing furnace, as well as reduced iron compacts obtained by the method and a method of melt-reducing the reduced iron compacts in a blast furnace. In the method of producing reduced iron compacts, the atomic molar ratio of carbon to oxygen chemically combined with iron, manganese, nickel, zinc and lead, in raw material powder comprising a mixture of iron oxide-containing powder and carbon-containing powder, or the ferric oxide content of the raw material powder, is in a specified range, the compact is produced so as to give a porosity in a given range, and the compact is put on the hearth of a reducing furnace equipped with a rotating hearth and is heated for heating reduction by the heat from the combustion gas in the upper part of the furnace, for firing reduction at above a prescribed temperature.

12 Claims, 4 Drawing Sheets

METHOD OF PRODUCING REDUCED IRON COMPACTS IN ROTARY HEARTH-TYPE REDUCING FURNACE, REDUCED IRON COMPACTS, AND METHOD OF PRODUCING MOLTEN IRON USING THEM

TECHNICAL FIELD

The present invention relates to a method of producing high-strength reduced iron compacts by heat reduction of compacts composed of iron oxide-containing powder in a rotary hearth-type reducing furnace, and to reduced iron compacts obtained by the method. It further relates to a method of producing molten iron using the reduced iron compacts in an iron-making blast furnace.

According to the invention, the term "compacts" includes those obtained by compacting iron oxide-containing powder into block, globular or granulate forms such as pellets, briquettes or the like, and the term "reduced iron compacts" includes those obtained by heating reduction of such iron oxide-containing compacts in a reducing furnace.

BACKGROUND ART

Various processes exist for the production of reduced iron or alloy iron, and processes of reduction in a solid state using carbon as the reducing agent are widely employed throughout the world because of the low operation and equipment costs and the ease of actual operation. Examples of such processes are those wherein reduction is accomplished by heating while rotating a compact of iron oxide and carbon powder on a refractory material with a rotary kiln or the like, and those wherein reduction is accomplished by putting on a moving hearth and heating by high temperature gas from above, as in, for example, the rotary hearth process.

Among such processes, the rotary hearth process is the one which offers the highest productivity. The rotary hearth process involves a system composed mainly of a firing furnace of a type in which a disk-shaped refractory hearth lacking the center portion is rotated at a fixed speed on rails, under an anchored refractory ceiling and walls (hereinafter referred to as "rotary hearth furnace"), and it is used for reduction of metal oxides (hereinafter referred to as "rotary hearth-type reducing furnace"). A rotary hearth furnace has a rotating disk-shaped hearth with the center portion lacking. The diameter of the disk-shaped hearth is from 10 to 50 meters and its width is from 2 to 6 meters.

The basic outline of operation in a rotary hearth process is as follows. First, the metal oxides such as ore or dust or sludge as the starting materials are mixed with an amount of carbon-based reducing agent necessary to reduce the oxides, and then compacts are produced using a granulating machine.

The starting materials used are metal oxides such as ore powder or metal oxide dust, and carbon as a reducing agent. In the production of reduced iron, fine iron ore such as pellet feed ore is used. Carbon is used as the reducing agent, but it preferably has a high non-volatile carbon (fixed carbon) content at up to about 1100° C. as the temperature at which a reduction reaction occurs. Coke powder or anthracite coal is suitable as such a carbon source.

Iron oxide-containing powder as the starting material is mixed with carbon-containing powder. The mixture is then compacted and supplied to a rotary hearth furnace spread on the hearth. In the rotary hearth furnace, the hearth is rotated and the compacts spread on the hearth are rapidly heated at a temperature as high as 1300° C. for 5 to 20 minutes as it is moved through each of the high-temperature sections of the furnace. The reducing agent (carbon) mixed in the compact causes reduction of the metal oxide in the compact during this time, producing the metal. The metallization rate differs depending on the metal to be reduced, but for iron, nickel or manganese it is over 70%, and it is above 30% even for reduction-resistant chromium. When treating dust generated by an iron-making process, the reduction reaction is combined with volatilizing removal of impurities such as zinc, lead, alkali metals and chlorine, thus facilitating recycling to a blast furnace or an electric furnace.

Because the compacts are stationary on the hearth in the rotary hearth furnace, an advantage is provided in that the compact does not readily disintegrate in the furnace. As a result, the problem of the powdered starting material adhering to the refractory material does not occur, and an advantageous bulk product yield is achieved. High productivity and the ability to use inexpensive coal-based reducing agents or powder starting materials are additional reasons for the increasing employment of this process in recent years.

The rotary hearth process is effective for reduction and impurity removal treatment of dusts generated in a blast furnace, converter or electric furnace or thickener sludge from a rolling process, and it may also be used as a dust-treatment process or as an effective process for metal resource recycling.

The equipment comprises a starting material pre-pulverizer, a starting material mixer, a granulator, a rotary hearth-type reducing furnace, a off-gas treatment apparatus and a reduced compact cooling apparatus.

As mentioned above, a reduction process wherein the compacts are put on a moving hearth and heated from above by the high-temperature gas, as in a metal oxide reduction process such as a rotary hearth process, involves no movement of the compacts on the hearth, and therefore destruction or powdering of the compact is minimized, such that the process is excellent from the standpoint of producing a strong reduced iron compacts (granules) and from the standpoint of productivity or production cost, and hence economical production can be achieved. However, further improvement in productivity and quality is desired. Specifically, it is necessary to accomplish more efficient reduction to increase productivity, while satisfying the physical conditions which facilitate use of the obtained reduced iron compact in later steps.

As a reduced compact (hereinafter referred to either as reduced iron compact or reduced iron pellets) is not used directly as a product, it must undergo final reduction and melting in later steps. In particular, with reduced iron pellets produced by a rotary hearth process, sulfur is absorbed from the carbon source into the metallic iron, resulting in a sulfur content of 0.1–0.3% in the reduced iron, such that it is unsuitable for direct use as a steel product. A desulfurization function is therefore necessary in the final reduction and melting step. An iron-making blast furnace has a desulfurizing function with the reduction and melting, and therefore production of molten iron using the reduced iron pellets in admixture with other starting materials in the iron-making blast furnace is an economical method for iron production.

For use in a blast furnace, however, it is necessary to produce reduced iron pellets with high strength. The reason for this is as follows. A large amount, as much as 2000–8000 tons, of ore and coke may build up in a blast furnace. A significant load therefore acts on the reduced iron pellets in the blast furnace, and the required crushing strength can be as high as $5\times10^6$ to $6\times10^6$ N/m$^2$ or greater.

Methods of producing high-strength reduced iron pellets by the rotary hearth process already exist in the prior art, as disclosed in Japanese Unexamined Patent Publication No. 2000-34526 and Japanese Unexamined Patent Publication No. 2000-54034, previously filed by the present inventors. The operation according to the technology disclosed in these publications is effective for production of high-strength reduced iron pellets, and it is therefore an indispensable technique for production of reduced iron pellets for use in blast furnaces. The reduced iron pellets have exceedingly high crushing strength and can therefore be directly used in the blast furnace.

However, the problem with operation based on these disclosed techniques has been a lack of fine management of the starting material conditions and reaction conditions. That is, even with these techniques, insufficient management of the reaction time has often resulted in reduced iron pellets with inadequate strength. Furthermore, the reaction time management is not quantitative, leading to a prolonged reaction time and therefore overconsumption of energy for heating and reduction. Another problem has been insufficient management of the conditions of the starting material components, or the conditions such as the size of the compact supplied to the reduction furnace for the rotary hearth process. A new technique which overcomes these problems has therefore been desired.

It has been the experience of the present inventors that when the iron oxide starting material is not carefully selected, the reduced iron compact product undergoes severe powderization even with appropriate operating conditions in the rotary hearth process. The present inventors therefore conducted numerous experiments while varying the starting material formulating conditions. As a result, it was found that of the iron oxide starting materials used, those with the highest ferric oxide ($Fe_2O_3$) blending ratios gave products (reduced iron compacts) with the highest powder ratios.

Here, "product" refers to the compact which is reduced after heating reduction (reduced iron compact), and it includes bulk reduced products, i.e. bulk reduced iron compacts or reduced iron pellets, as well as powdered reduced products, i.e. powdered reduced iron compacts (hereinafter referred to as "powder"). The powder ratio is the ratio of the mass of reduced product which passes through a 2 mm sieve with respect to the total mass of the reduced product before passing through the sieve.

For example, experiments conducted by the present inventors demonstrated that severe generation of powder occurs when the proportion of ferric oxide in the starting material powder exceeds 60%, for pellets produced from raw material powder with a mean particle size of 45 $\mu$m using a pan-type granulator. Moreover, with a ferric oxide proportion of greater than 70%, the powder ratio of the product (reduced iron compact) was as high as 15–25% even if the operating conditions of the rotary hearth-type reducing furnace were satisfactory. Further investigation by the present inventors confirmed that the powder generated in the furnace is inferior in terms of reduction rate and dezincification. This was because the powder has a large specific surface area and more easily contacts the combustion gas in the furnace on the hearth, thereby being affected by the oxidizing atmosphere of carbon dioxide gas and water vapor in the combustion gas, and being inhibited the reduction reaction. In other words, powderization of the compact creates the problem of a lower proportion of highly valuable bulk product (bulk reduced compact) and a lower average reduction rate of the product. As a result, while it has been known that inhibiting such powderization is important in order to reduce compacts of containing ferric oxide to obtain products having a high reduction rate with a metal ratio of 75% or greater, no effective countermeasure has existed in the prior art.

As no effective means for solving these problems has existed in the prior art, no efficient reduction treatment has been carried out to prevent powderization. Consequently, a new technique for reducing powderization of compacts has been desired in reduction of ferric oxide-containing iron oxide compacts in rotary hearth-type reducing furnaces.

It is therefore an object of the present invention to 1) efficiently obtain reduced iron compacts with high crushing strength and 2) to efficiently reduce iron oxide starting materials containing ferric oxide in order to obtain reduced iron compacts with low powder and high reduction rates, in a solid reduction-type heating reducing furnace such as a rotary hearth-type reducing furnace, as well as to achieve reduction melting of reduced iron compacts in blast furnaces.

DISCLOSURE OF THE INVENTION

The present invention was accomplished for the purpose of overcoming the problems explained above, and its gist is as follows.

(1) A method of producing a reduced iron compact in a rotary hearth-type reducing furnace, characterized by producing a compact wherein the atomic molar ratio between the carbon in the raw material powder comprising a mixture of iron oxide-containing powder and carbon-containing powder and the included oxygen which is chemically combined with the metal elements that participate in reduction reaction in a carbon monoxide atmosphere at 1300° C., or the ferric oxide content, is within a specified range, with the porosity also within a specified range, putting the compact on the hearth of a reducing furnace equipped with a rotating hearth, and heating it to above a prescribed temperature by the heat from the combustion gas in the upper part of the furnace for heating reduction.

(2) A method of producing a reduced iron compact in a rotary hearth-type reducing furnace, characterized by producing a compact with a porosity of 20–33% using a raw material powder wherein the total iron content is at least 40 mass % and wherein, among the included elements, the atomic molar ratio of carbon to oxygen chemically combined with iron, manganese, nickel, zinc and lead is in the range of 0.5–1.5, putting the compact on the hearth of a reducing furnace equipped with a rotating hearth, and heating it for heating reduction by the heat from the combustion gas in the upper part of the furnace, such that the time of exposure to the gas atmosphere at 1200° C. or above is 1.0–3.0 times the minimum heating time (Ta) represented by formula <2> below and the maximum temperature of the gas in the furnace is no higher than 1400° C.

$$Ta=0.045\ \exp(7100/T)+0.12V_p^{1/3} \qquad <2>$$

Ta: minimum heating time (min)

T: mean gas temperature in furnace zone above 1200° C. (K)

$V_p$: Mean volume of compact (mm$^3$)

(3) A method of producing a reduced iron compact in a rotary hearth-type reducing furnace, characterized by producing a compact with a porosity of >33 and ≦55% using a raw material powder wherein the total iron content is at least 40 mass % and wherein, among the included elements, the atomic molar ratio of carbon to oxygen chemically combined with iron, manganese, nickel, zinc and lead is in the range of 0.5–1.5, putting the compact on the hearth of a reducing furnace equipped with a rotating hearth, and heating it for heating reduction by the heat from the combustion gas in the upper part of the furnace, such that the time of exposure to the gas atmosphere at 1200° C. or above is 1.0–3.0 times the minimum heating time (Tb) represented by formula <3> below and the maximum temperature of the gas in the furnace is no higher than 1400° C.

$$Tb=0.05\ \exp(7100/T)+0.14V_p^{1/3} \quad <3>$$

Tb: minimum heating time (min)

T: mean gas temperature in furnace zone above 1200° C. (K)

$V_p$: Mean volume of compact ($mm^3$)

(4) A method of producing a reduced iron compact in a rotary hearth-type reducing furnace according to (2) or (3) above, characterized in that the volume of the compact is 100–14,000 $mm^3$.

(5) A method of producing a reduced iron compact in a rotary hearth-type reducing furnace according to (2) or (3) above, characterized in that the total mass of silicon oxide, aluminum oxide, calcium oxide, magnesium oxide and phosphorus oxide in the compact is no greater than 30% of the mass of the compact.

(6) A method of producing a reduced iron compact in a rotary hearth-type reducing furnace according to any one of (2) to (5) above, characterized in that the heating reduction is carried out with an average number of no more than 2 laminated layers when the compact is put on the hearth of the reducing furnace equipped with a rotating hearth.

(7) A method of producing a reduced iron compact in a rotary hearth-type reducing furnace, characterized by producing a raw material powder comprising a mixture of iron oxide-containing powder and carbon-containing powder into a compact with a porosity which is at least the suitable porosity V1 represented by formula <4> below, putting the compact on the hearth of a reducing furnace equipped with a rotating hearth, and heating it for heating reduction at a temperature of 1100° C. or higher by the heat from the combustion gas in the upper part of the furnace.

$$V1=0.55R-12 \quad <4>$$

where R is the mass ratio of ferric oxide in the compact and V1 is the suitable porosity of the compact.

(8) A method of producing a reduced iron compact in a rotary hearth-type reducing furnace, characterized by producing a raw material powder comprising a mixture of iron oxide-containing powder and carbon-containing powder blended with at least 10 mass % of a powder having a mean particle size of no greater than 10 $\mu$m and comprising a total of at least 65 mass % of one or more from among metallic iron, ferrous oxide and magnetite, into a compact with a porosity which is at least the suitable porosity V2 represented by formula <5>below, putting the compact on the hearth of a reducing furnace equipped with a rotating hearth, and heating it for heating reduction at a temperature of 1100° C. or higher by the heat from the combustion gas in the upper part of the furnace.

$$V2=0.5R-14 \quad <5>$$

where R is the mass ratio of ferric oxide in the compact and V2 is the suitable porosity of the compact.

(9) A method of producing a reduced iron compact in a rotary hearth-type reducing furnace, characterized by producing a raw material powder comprising a mixture of iron oxide-containing powder and carbon-containing powder with a ferric oxide content of no greater than 85 mass %, into a compact with a porosity of at least 40%, putting the compact on the hearth of a reducing furnace equipped with a rotating hearth, and heating it for heating reduction at a temperature of 1100° C. or higher by the heat from the combustion gas in the upper part of the furnace.

(10) A method of producing a reduced iron compact in a rotary hearth-type reducing furnace, characterized by producing a raw material powder comprising a mixture of iron oxide-containing powder and carbon-containing powder blended with at least 10 mass % of a powder having a mean particle size of no greater than 10 $\mu$m and comprising a total of at least 65 mass % of one or more from among metallic iron, ferrous oxide and magnetite, into a compact with a porosity of at least 40%, putting the compact on the hearth of a reducing furnace equipped with a rotating hearth, and heating it for heating reduction at a temperature of 1100° C. or higher by the heat from the combustion gas in the upper part of the furnace.

(11) A method of producing a reduced iron compact in a rotary hearth-type reducing furnace according to (9) or (10) above, characterized in that the compact is produced by extruding the moisture-containing raw material powder or raw material mixture from a perforated die set against a metallic plate using an extruding roller, or by using a screw-type extruder in a metal casing for extrusion from a perforated die at an end plate set to one side of the metal casing.

(12) A method of producing a reduced iron compact in a rotary hearth-type reducing furnace according to (8) or (10) above, characterized in that dust with a mean particle size of 10 $\mu$m collected by a converter gas recovery apparatus is used as the powder having a mean particle size of no greater than 10 $\mu$m and comprising a total of at least 65 mass % of one or more from among metallic iron, ferrous oxide and magnetite.

(13) A method of producing a reduced iron compact in a rotary hearth-type reducing furnace according to any one of (7) to (10) above, characterized in that the atomic mole of carbon in the compact is 0.5–1.5 times with respect to the atomic mole of oxygen chemically combined with oxydes reduced in a reducing atmosphere at 1300° C.

(14) An iron oxide reduced compact characterized in that it is heated and reduced in a reducing furnace equipped with a rotating hearth, the metallic iron proportion is at least 40 mass %, the carbon content is no greater than 4% of the mass of the metallic iron, the total mass of silicon oxide, aluminum oxide, calcium oxide, magnesium oxide and phosphorus oxide present is no greater than 35% of the mass of the reduced compact, and the apparent density is at least 1.6 $g/cm^3$.

(15) An iron oxide reduced compact characterized in that it is sintered and reduced by a 7 minute or longer exposure to an atmospheric temperature of 1200–1400° C. in a reducing furnace equipped with a rotating hearth, the metallic iron proportion is at least 40 mass %, the carbon content is no greater than 4% of the mass of the metallic iron, the total mass of silicon oxide, aluminum oxide, calcium oxide, magnesium oxide and phosphorus oxide present is no greater than 35% of the mass of the reduced compact, and the apparent density is at least 1.6 $g/cm^3$.

(16) An iron oxide reduced compact according to (14) or (15) above, characterized in that the mean volume is 70 mm3 or greater.

(17) A method of producing molten iron, characterized by subjecting an iron oxide reduced compact according to (16) above to reduction melting in an iron-making blast furnace.

BEST MODE FOR CARRYING OUT THE INVENTION

Figure 1:
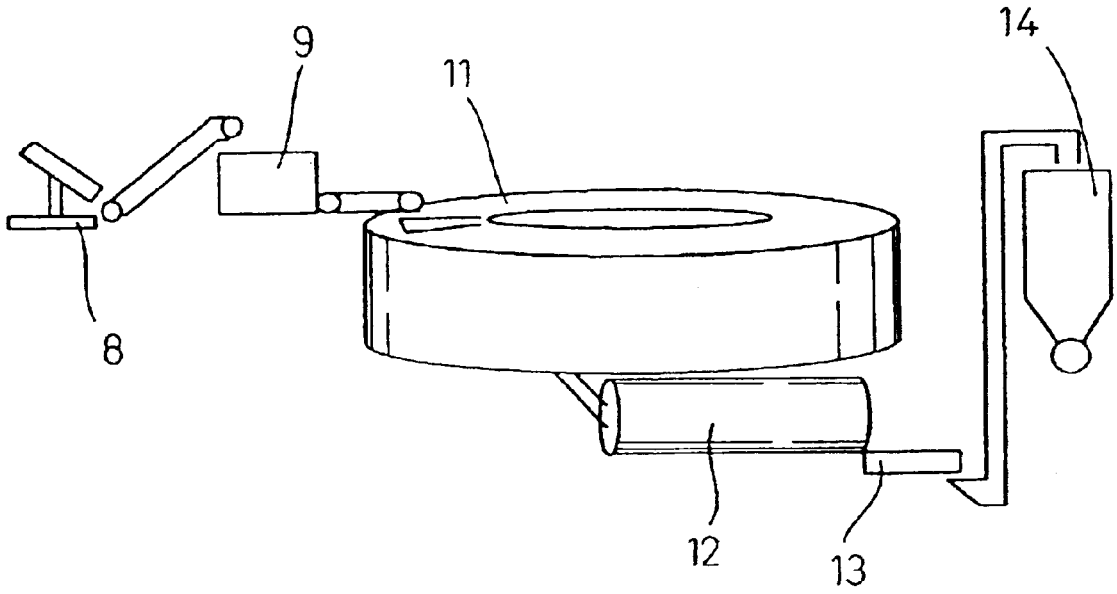
FIG. 1 is a schematic view of an example of the entire process including a rotary hearth-type reducing furnace used to carry out the invention, and its accessory parts.

The technique of the invention will first be explained for production of a high crushing strength, high-strength reduced iron compact (reduced iron pellets) in a reducing furnace whereby iron oxide in a solid state is reduced in a rotary hearth-type reducing furnace using carbon as the reducing agent. FIG. 1 shows an example of an apparatus for the rotary hearth process used in carrying out the invention, as the basis for an explanation of the method of the invention.

Figure 2:
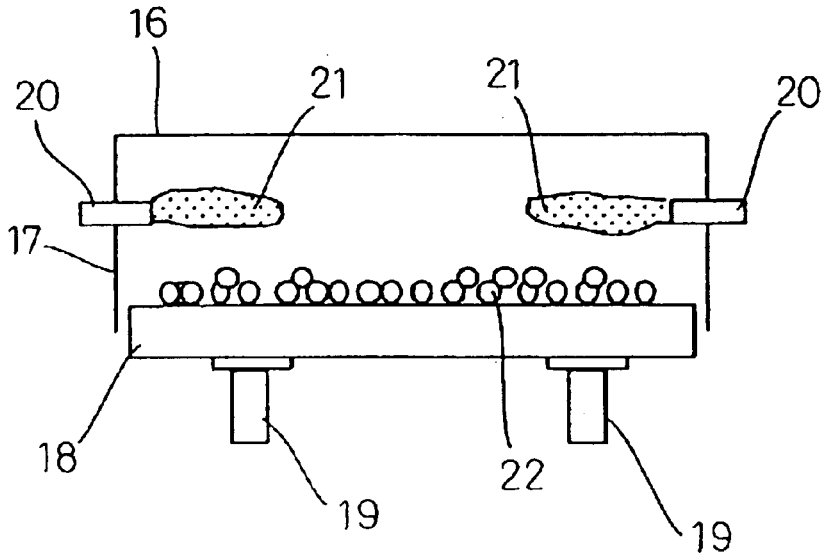
FIG. 2 is a cross-sectional view of a rotary hearth-type reducing furnace.

The apparatus of FIG. 1 comprises a raw material powder compactor 8, a compact drying apparatus 9, a rotary hearth-type reducing furnace 11, a reduced iron pellet cooling apparatus 12, a reduced iron pellet sifting apparatus 13 and a reduced iron pellet stockpiling bin 14. FIG. 2 shows a cross-sectional view of the rotary hearth-type reducing furnace 11. A hearth 18 rotating above wheels 19 is situated under an anchored refractory ceiling 16 and furnace wall 17. A plurality of burners 20 are mounted in the furnace wall 17, and a flame controls the temperature and atmosphere in the furnace. The compact 22 produced by the compactor 8 is loaded into the furnace and heated on the hearth by gas emission, from above, for a reduction reaction.

First, powder containing iron oxide such as powdered iron ore or converter gas dust is mixed with carbon-containing powder such as coke powder, to prepare a raw material powder. The raw material powder is basically composed of iron oxide-containing powder and carbon-containing powder, but it may also include, in addition to iron oxide and carbon-containing powder, some metallic iron powder or impurities. At the compactor 8, the mixed powder (raw material powder) is molded into a form for easy handling. The molding method will most generally be a pelleting method using a pan-type granulator, whereby spherical pellets are made while crushing the raw material powder around granulating nuclei on a slanted disc, as is used in the apparatus shown in FIG. 1. Another molding method which may be used is a compaction molding briquette producing method or extrusion-type molding method.

Here, the compact must have a strength capable of withstanding conveying to the reduction furnace. In the case of pellets formed by a pan-type granulator, the pellet strength is increased if they are dense with a porosity of from 20 to 33%. For a briquette production method or extrusion-type molding method, only a low density compact with a porosity of 30 to 55% can be obtained, and therefore the strength is increased using a binder or by moisture cohesion.

Of the iron oxide and impurities in the compact, the oxides with high reducibility in a carbon monoxide atmosphere at a temperature of about 1200° C. will be reduced by the carbon in the furnace of the rotary hearth-type reducing furnace 11. The proportion of the carbon and the iron oxide-including oxides is preferably such that the atomic molar ratio of carbon with respect to the oxygen (active oxygen) in the oxides ((atomic moles of carbon)/(atomic moles of active oxygen)) is 0.5–1.5. The reason is as follows. For reduction by a rotary hearth process, the central reaction is reduction under conditions in which the oxygen in the metal oxide and the carbon form carbon monoxide. The starting materials are therefore formulated so that the atomic molar ratio of carbon to active oxygen (hereinafter referred to as "carbon equivalent ratio") is approximately 1. However, depending on the atmosphere gas and temperature, a portion may participate in reduction even with carbon dioxide. Also, as consumption of carbon by water vapor or carbon dioxide gas at high temperature in the furnace is also considerable in some cases, an excess of carbon is often necessary. That is, the reaction conditions in the furnace are used to decrease the carbon equivalent ratio to 0.5 or increase it to 1.5. The major oxides of active oxygen included in starting materials for production of reduced iron compacts are usually oxides of iron, manganese, nickel, zinc and lead.

The compact comprising the iron oxide-containing powder and carbon-containing powder produced by the procedure described above is spread onto the hearth 18 in the furnace of the rotary hearth-type reducing furnace 11, for heating reduction. The number of spread layers of the compact is preferably no more than two, for the following reason. Heat transfer to the compact is accomplished by emission from the gas above the compact and contact/emission from the hearth 18. Therefore, the compact can be directly heated with up to 2 layers, but with more than 2 layers the compact in the middle is only heated after heating above and below the compact has progressed. This has led to a problem in that reduction of the compact at the middle is not completed for a long time even after reduction of the upper and lower compact has been completed.

The reduction reaction initiates at about 1100° C. and proceeds vigorously after the temperature exceeds 1200° C. Consequently, the gas in the furnace at the reducing zone must be at a temperature of least 1200° C. However, if the temperature exceeds 1400° C., the slag component or reduced iron in the compact reacts with the residual carbon, and the resulting iron/carbon compound melts. A portion of the compact melts and adheres between the surrounding compact, or fuses with the hearth 18. This is problematic because the compact can no longer be discharged from the furnace and the reducing temperature is preferably in the range of 1200–1400° C. Another problem that may occur when the temperature exceeds 1400° C. is surface separation between the slag component and reduced iron, which results in lower strength of the compact.

The present inventors conducted the following analysis, assuming that the length of time that the compact is exposed to the section with a gas temperature of 1200° C. or above, as the condition for a vigorous reaction, is an important index for progress of the reduction reaction. As sintering among the produced metallic iron particles begins at a moment where the reduction reaction has progressed to some extent at this temperature, the progress of this sintering was also analyzed.

The state of progress of the reduction reaction usually differs depending on the temperature. In such a simple inorganic reaction between iron oxide and carbon, the reaction rate is strictly governed by the temperature. A reaction rate is generally represented by R=A exp (−G/kT) (where R is the reaction rate constant, A is a constant, G is the activation energy, k is the gas constant and T is the absolute temperature). The rate of sintering reaction of the metallic iron powder which occurs after the reduction reaction is similarly temperature-dependent. The present inventors therefore investigated the relationship between the internal furnace temperature in the reduction zone in a rotary hearth process and the exposure time to a gas temperature of 1200° C. or above, with respect to the iron oxide reduction rate and reduced iron pellet crushing strength.

In experiments conducted by the present inventors, it was found that an important condition for ensuring the strength in use of reduced iron pellets in a blast furnace is the progress of the reduction reaction, to achieve a high metallization rate, and the progress of sintering of the metal powder produced by reduction. If the reduced iron pellet strength and reduction conditions (the mean gas temperature in the reduction zone and the exposure time to gas at 1200° C. or above) are used as the basis for analysis, the minimum heating time (Tc) to achieve a crushing strength of $5\times10^6$ N/m$^2$ or higher can be represented by the following formula:

$$Ta=A\exp(7100/T)+BV_p^{1/3} \quad <1>$$

Ta: minimum heating time (min)

T: mean gas temperature in furnace zone above 1200° C. (K)

$V_p$: Mean volume of compact (mm$^3$)

A, B: constants

In conducting this experiment, the present inventors also found that the minimum heating time changes even with the size of the compact, as indicated by the second member at the right side of formula <1>. The size is preferably expressed in terms of volume because of the varying shapes of the compact, and therefore the effect of the volume has been placed in this formula as an index of the size of the compact. This effect is apparent because of the phenomenon whereby a longer time is required for heating to the interior in the case of a large compact.

The present inventors further discovered that A and B are constants that differ depending on the porosity of the compact starting material which is charged into the reducing furnace. A compact with a small porosity, such as a porosity of 20–33% in the case of dense pellets produced with a pan-type granulator, undergoes reaction and sintering at a rapid rate, such that formula <2> below may be applied.

$$Ta=0.045\exp(7100/T)+0.12V_p^{1/3} \quad <2>$$

Figure 3:
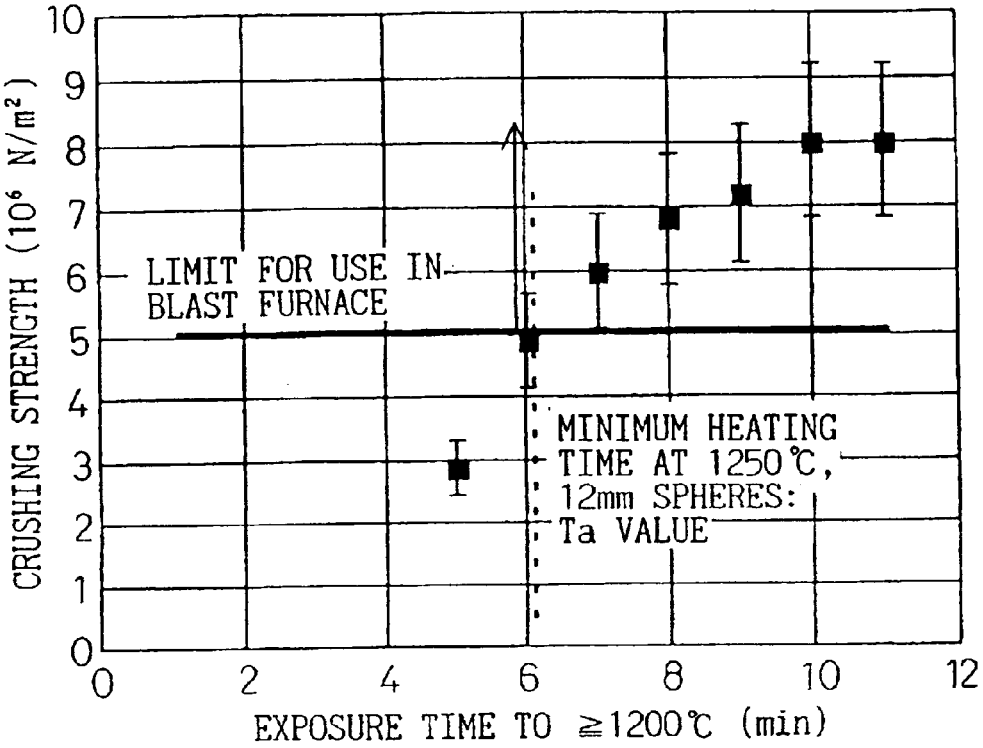
FIG. 3 is a graph showing the relationship between time exposed to an atmospheric temperature of 1200° C. or higher and the crushing strength of reduced pellets, where a compact of spheres with a porosity of 27% and a diameter of 12 mm was subjected to heat reduction at a mean gas temperature of 1250° C.

FIG. 3 shows an example of the relationship between the exposure time to an atmosphere of 1200° C. or above and the crushing strength, for a compact having such a porosity. The treatment involved heating reduction at a mean gas temperature of 1250° C., with a compact having a diameter of 12 mm and a porosity of 27%. The lengths of the accompanying lines in the plot of the graph indicate the statistical calculation error, with the range of the line lengths indicating a reliability of 90%. As seen in FIG. 3, Ta calculated from the gas temperature and compact size was 6.2 minutes, while the experimental results also indicated that a time exceeding 6 minutes resulted in a reduced iron pellet crushing strength of over $5\times10^6$ N/m$^2$.

A large compact with rough packing of the raw material powder particles and having a porosity of greater than 33% and up to 55% produces a slower reaction and sintering, with large constants for A and B in the following formula <3>:

$$Tb=0.05\exp(7100/T)+0.14V_p^{1/3} \quad <3>$$

Figure 4:
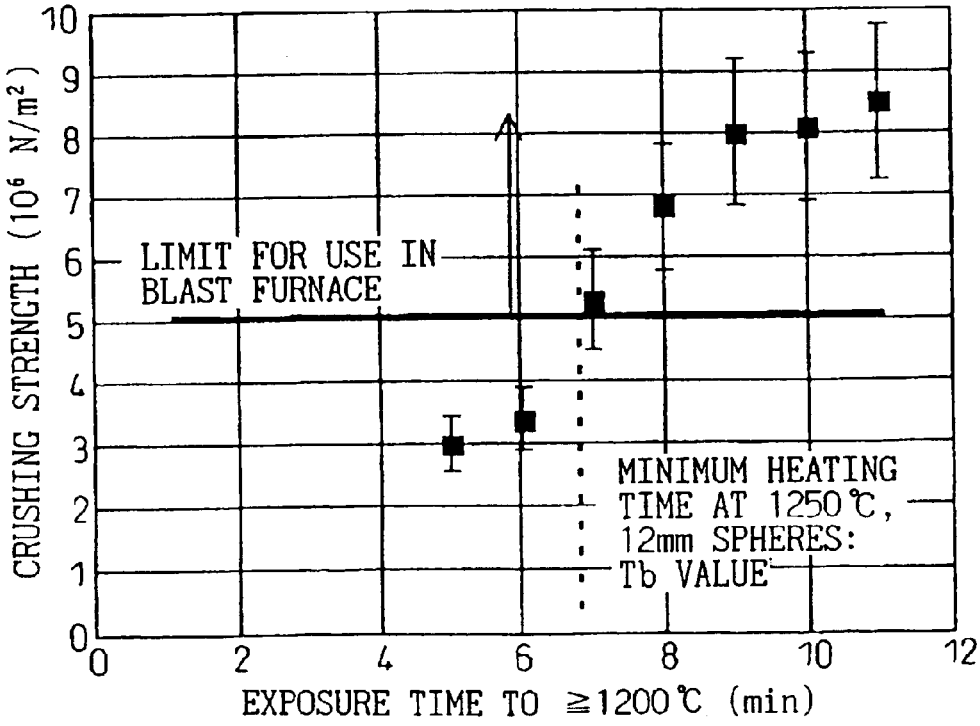
FIG. 4 is a graph showing the relationship between time exposed to an atmospheric temperature of 1200° C. or higher and the crushing strength of reduced pellets, where a compact of spheres with a porosity of 47% and a diameter of 12 mm was subjected to heat reduction at a mean gas temperature of 1250° C.

That is, whenever the minimum heating time represented by this formula was exceeded, it was possible to achieve a reduced iron pellet crushing strength of over $5\times10^6$ N/m$^2$. FIG. 4 shows an example of the experimental results obtained under these conditions. The results shown in FIG. 4 are for heating reduction of a compact with a diameter of 12 mm and a porosity of 47%, with a mean gas temperature of 1250° C. The lengths of the accompanying lines in the plot of the graph indicate the statistical calculation error, with the range of the line lengths indicating a reliability of 90%. The value for Tb calculated from the gas temperature and compact size was 6.8 minutes. The line of 6.8 minutes is shown in the Figure. These experimental results also indicated that the strength was insufficient with a heating reduction time of 6 minutes or less, whereas a time of 7 minutes or longer resulted in a reduced iron pellet crushing strength of over $5\times10^6$ N/m$^2$.

However, the present inventors discovered that when the compact volume exceeded 14,000 mm$^3$ (a diameter of 25 mm if the shape is nearly spherical), it sometimes occurs that the strength of the compact starting material charged into the reducing furnace is lower, and that the reduced iron pellets exhibit abnormal shapes, thereby also lowering the strength. In the case of a large compact, the reaction at the center section becomes more vigorous after completion of the reaction at the surface. As a result, the reaction finishes earlier at the sections near the surface, and sintering between the metallic iron powder begins immediately. Because of the slower reduction at the interior, however, the reduction reaction continues to proceed even after sintering of the surface. Carbon monoxide gas is generated with reduction of the interior in the latter half period of the sintering, and the dense surface prevents escape of the gas, thereby increasing the internal pressure and creating mechanical defects in the reduced iron pellet. As a result, the shape of the reduced iron pellet becomes abnormal and the strength is lowered.

With a compact volume of 100 mm$^3$ or smaller (a diameter of 5 mm or smaller if the shapes are nearly spherical), the compact is too small and enters into the spaces between the surrounding compact such that it can not receive emission from the furnace gas, resulting in the problem of a non-uniform reaction rate. The reduction rate and strength are therefore unstable with a compact size below this level. In addition, a compact of 100 mm3 size loses approximately 30% of its volume upon reduction. Consequently, when used in a blast furnace, for example, the volume of the reduced iron pellets is preferably 70 mm$^3$ or greater.

The reaction and sintering time will vary based on the operating conditions and, when it is necessary to produce higher strength reduced iron pellets with a crushing strength of greater than $5\times10^6$ N/m$^2$, it may be necessary to conduct firing for a longer time than the minimum heating time. The reduced iron pellet crushing strength was improved at up to 3 times the minimum heating time, but no further improvement in strength was observed with firing for a longer time. Consequently, the time for sintering reduction of the compact at 1,200° C. or above is satisfactory in a range of 1.0 to 3.0 times the minimum heating time.

The present inventors also investigated the relationship between components and the crushing strength of the reduced iron pellet. It was discovered that the crushing strength is even greater when the iron oxide ratio of the raw material powder is high. The reason for this phenomenon is that metallic iron has a faster mass transfer at 1200–1400° C., and therefore the metallic iron powder in the reduced iron pellets sinters even within a short time. The density and strength are therefore increased with reduced iron pellets having a high metallic iron ratio. On the other hand, oxides such as aluminum oxide have a slow mass transfer, and therefore sufficient sintering does not occur with only a few minutes of heating at this temperature. The strength of reduced iron pellets with a high metallic iron ratio is therefore increased, and the strength of those with a low metallic iron ratio is lower. The present inventors found that when the metallic iron ratio of the reduced iron pellets is at least 40%, it is possible to obtain reduced iron pellets with a crushing strength of $5\times10^6$ N/$^2$ or greater, which is the limit for use in a blast furnace. This strength allows long-distance transport by truck or ship. The metallic iron ratio is the mass ratio of metallic iron in the reduced iron compact, and is represented by (metallic iron mass/reduced iron compact mass).

The method of producing reduced iron pellets with a metallic iron ratio of 40% or greater is as follows. First, when the total iron ratio of the raw material powder (the mass ratio of the total iron element included) is at least 40%, then reduced iron pellets with a metallic iron ratio of at least 40% can be obtained, if the mass reduction of oxygen and carbon during reduction is considered. In the reduction reaction of the invention, the reacted oxygen and carbon form carbon monoxide and carbon dioxide, which are released from the compact. As a result, the mass of the reduced iron pellets is about 65–80% of the compact. If the total iron ratio in the raw material powder is greater than 40%, then the total iron ratio of the reduced iron pellets will increase to 50–60%. Also, as the iron reduction rate is at least about 70% under the reaction conditions described above, the metallic iron ratio of the reduced iron pellets will be 40% or greater.

However, when the proportion of oxides that do not undergo reduction in the compact (silicon oxide, aluminum oxide, calcium oxide, magnesium oxide and the like; hereinafter referred to as "slag products") is high, the strength of the reduced iron pellets after reduction is lower. The present inventors have found that when the slag product ratio of the compact exceeds 30%, the strength of the reduced iron pellets is lower than $5\times10^6$ N/m$^2$ even if the other conditions are satisfactory. This occurs because, unlike the metallic iron particles, the slag products have a slow mass transfer and therefore adequate sintering is not completed during the few minutes under conditions of 1200–1400° C. Also, when the slag product ratio of the compact exceeds 30%, the slag product ratio of the reduced iron pellets after reduction exceeds 35%.

Such a raw material powder having a sufficient carbon proportion is subjected to reduction reaction at a temperature of 1200–1400° C., and sintered. The firing time must be longer than the aforementioned minimum heating time, but under conditions with a normal compact volume, gas temperature and porosity, exposure to gas at 1200° C. or above for 7 minutes or longer will be sufficient.

As indicated in Japanese Unexamined Patent Publication No. 2000-34526, as a prior invention by the present inventors, it has been confirmed that with a high residual carbon content in reduced iron pellets, the strength of the reduced iron pellets is reduced even under the conditions of the present invention. It was found that under the operating conditions of the present invention, a residual carbon content of greater than 4% of the metallic iron mass results in lower crushing strength of the reduced iron pellets. This is because, when the amount of dissolved carbon is up to 4% of the metallic iron and the undissolved carbon is present among the particles in the reduced iron pellets, the carbon prevents sinter bonding of the metallic iron, resulting in lower strength. This residual carbon concentration is obtained when raw material powder with the aforementioned carbon and active oxygen ratio is adequately reduced. In a reducing furnace for an ordinary rotary hearth process, a carbon equivalent ratio of 0.5 or greater will result in a metallic iron ratio (metallization rate) of 65% or greater of the total iron, thus allowing production of considerably reduced pellets with high strength. The metallization rate is the mass proportion of the metallic iron with respect to the total iron content. However, as the carbon equivalent ratio begins to exceed 1.3, carbon in excess of that needed for reduction of the iron oxide tends to be generated after the reaction, while if it exceeds 1.5, the residual carbon ratio of the reduced iron pellets becomes greater than 4 mass % of the metallic iron, such that the strength of the reduced iron pellets falls below the prescribed target value. The carbon equivalent ratio should therefore be in the range of 0.5–1.5.

When reduced iron pellets were produced by the operating method described above, the reduced metallic iron particles sintered, resulting in dense reduced iron pellets and therefore a high strength product, and the apparent specific density was in the range of 1.6–4.5 g/cm$^3$. The reduced iron pellets obtained under these conditions had a crushing strength of $5\times10^5$ N/m$^2$ or greater. The compact had a low porosity and was highly dense, while the density of the reduced iron pellets produced therefrom was also high. The apparent density of the reduced iron pellets is also affected by the porosity of the compact.

With spherical pellets having a porosity of 20–30%, the apparent specific density of the reduced iron pellets was 3.0–4.5 g/cm$^3$. With briquettes or extruded compacts, the porosity was 30–55% and the apparent specific density of the reduced iron pellets produced from the compact was 1.6–3.5 g/cm$^3$. Consequently, if the porosity of the compact is in the range of 20–55%, it is possible to produce reduced iron pellets which are dense and of high strength. Incidentally, in most compacting methods it is technically difficult to produce compacts with a porosity of less than 20% in an economical manner.

Ordinary temperature reduced iron pellets are produced by cooling, under suitable conditions, the high-temperature reduced iron pellets produced by the method described above. The reduced iron pellets can withstand long-distance transport or use in an iron-making blast furnace. The reduced iron pellets are preferably used in an iron-making blast furnace after being blended with another raw material of a blast-furnace, in order to melt the slag products and solid solution impurities such as sulfur and phosphorus for their removal. In the blast furnace, the remaining iron oxide is reduced and melted. The slag products thus become molten and are separated from the molten iron. The sulfur dissolves into the slag to achieve a desulfurization rate of about 90%. The produced molten iron is used as a starting material for a converter or electric furnace.

The technique of the invention for production of reduced iron compacts with a low powderization rate will now be explained.

The present inventors first investigated the behavior of ferric oxide particles during reduction of ferric oxide in compacts in a rotary hearth-type reducing furnace. The results of the investigation confirmed that ferric oxide undergoes volume expansion in the solid reduction reaction. In a reducing atmosphere at 1100° C. or higher, $Fe_2O_3$ is first converted to $Fe_3O_4$ and then to FeO and finally to metallic iron. During the transition from $Fe_2O_3$ to $Fe_3O_4$, the crystal lattice expands, resulting in a larger crystal volume. It was found that expansion of the $Fe_2O_3$ particles during reduction results in expansion of the compact during reduction, and thus powderization of the compact.

In order to solve this problem of powderization of the compact due to expansion of ferric oxide during reduction, the present inventors invented a method of controlling distribution of the particles in the compact. Specifically, it was found that prevention of the actual expansion of ferric oxide with such solid reduction was difficult, and consequently that it is more effective to produce a compact which does not become powder even with expansion.

The present inventors then found that it is effective to appropriately set the porosity of the compact (void ratio in the compact) to match the proportion of expansion of the ferric oxide during reduction, thereby absorbing the degree of expansion. That is, as the expansion during reduction is considerable when the proportion of ferric oxide is large, the expansion can be absorbed by increasing the porosity. Similarly, it was found that when the proportion of ferric oxide is small, reduction can be accomplished without problems in compacts even with a low porosity.

Figure 5:
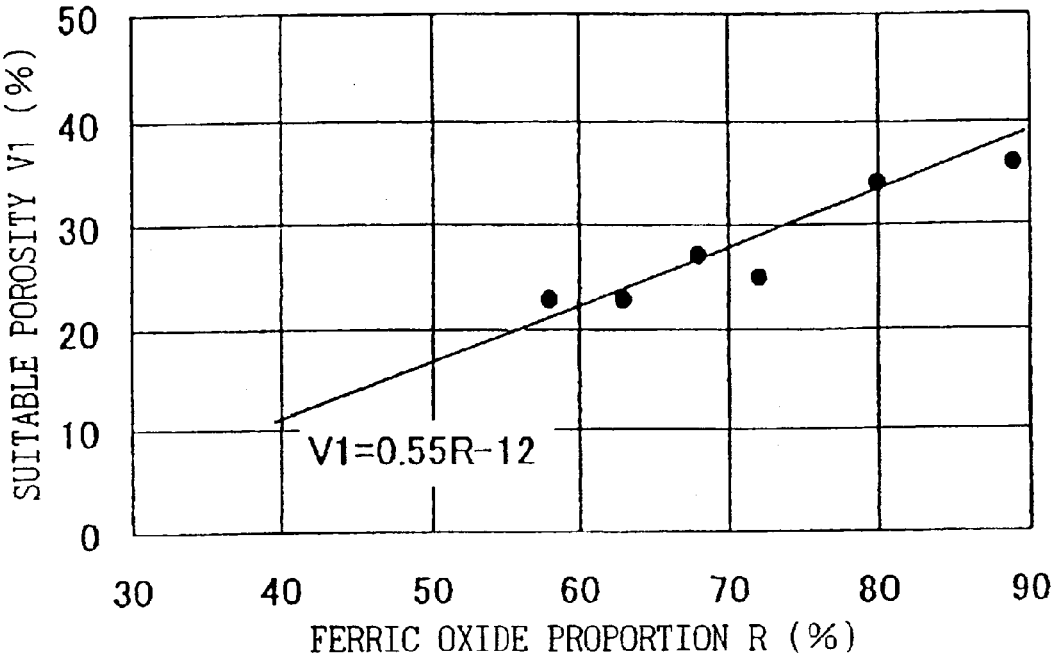
FIG. 5 is a graph showing the relationship between the ferric oxide content of a compact reduced in a rotary hearth-type reducing furnace and the suitable porosity for low powderization conditions.
Figure 6:
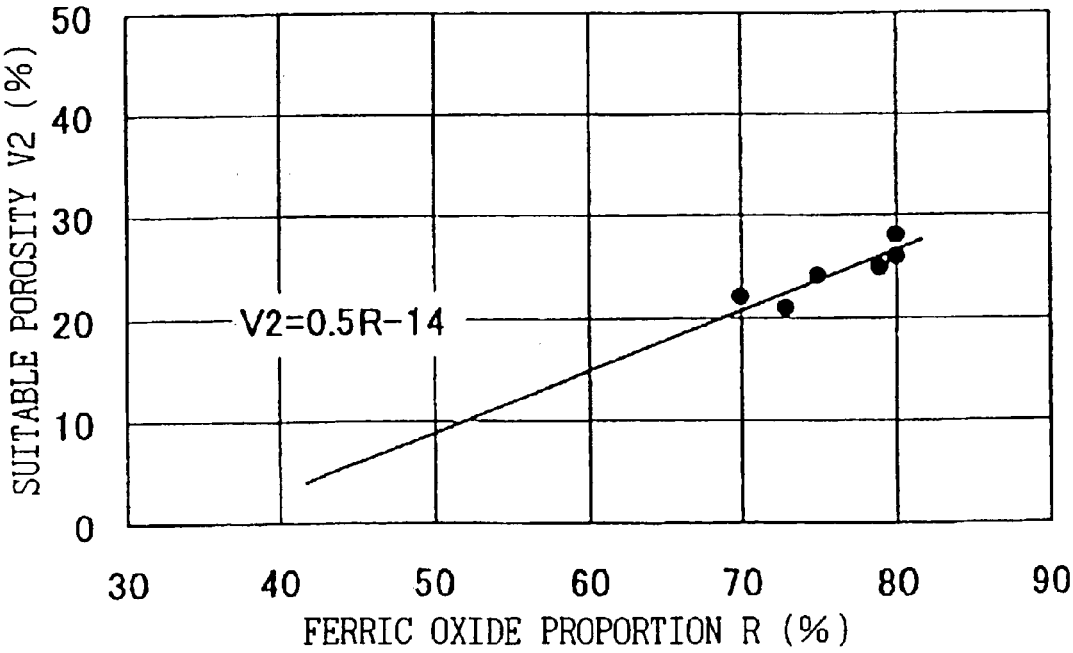
FIG. 6 is a graph showing the relationship between the ferric oxide content of a compact reduced in a rotary hearth-type reducing furnace and the suitable porosity for low powderization conditions, where fine metallic iron, ferrous oxide and magnetite were added at 10 mass % to the raw material powder.

The present inventors experimented with the production of compacts with varying degrees of porosity from 25–55%. The results were used to determine the range of porosity which can prevent powderization due to the effect of the ferric oxide. It was found that with a higher proportion of ferric oxide, the limit of porosity was also higher. Based on these experimental results, there was determined a relationship between the ferric oxide content and the limit of porosity which does not cause powderization of the compact (suitable porosity 1). The results are shown in FIG. 5. The suitable porosity 1 is defined as the minimum porosity which gives a powderization rate of no greater than 10%, for a given ferric oxide mixing proportion. The powderization rate is the proportion of the mass of the reduced compact which passes through a 2 mm sieve with respect to the total mass before sifting. The results of this investigation indicated the relationship represented by the following formula <4>:

$$V1=0.55R-12 \quad <4>$$

Here, V1 is the suitable porosity 1 (%), and R is the ferric oxide content of the compact (mass %). In other words, a powderization rate of 10% or less can be achieved so long as the porosity of the compact exceeds the V1 value.

According to the present invention, the porosity is controlled by the compact production method. However, the porosity can be controlled in a range of 23–30% with a pan-type granulating apparatus. Also, the porosity can be controlled in a range of 30–42% with a briquette molding apparatus, while the porosity can be controlled in a range of 40–55% with an extrusion-type molding apparatus. It is therefore possible to control the porosity of the compact within a narrow range by consistently using the same type of molding apparatus. For example, for molding with a pan-type granulating apparatus, the porosity is controlled by varying the particle size distribution of the raw material powder or varying the water content during molding. With a briquette-type molding apparatus, the porosity is controlled by varying the particle size distribution of the raw material powder or varying the compaction pressure. With an extrusion-type molding apparatus, the porosity is controlled by varying the particle size distribution of the raw material powder and by varying the amount of water added for water content adjustment of the powder.

However, because of the narrow range of porosity control with the same molding apparatus, it is effective to change the type of molding apparatus if a large variation in porosity is desired. Since an extrusion molding apparatus allows the porosity to be increased, it can be applied for a rather wide range of ferric oxide mixing proportions, and no problem of powderization occurs so long as the ferric oxide proportion is no greater than 80% of a compact molded with an extrusion-type molding apparatus.

Upon further experimentation on methods of absorbing the expansion of ferric oxide, the present inventors discovered that by combining the raw material powder with a powder which absorbs expansion while also acting as a binder, it is possible to lower the porosity limit at which no powderization occurs. A powder containing metallic iron, ferrous oxide and magnetite iron oxide with a small particle size may be used as the expansion absorbing agent.

The reason is primarily that ferrous oxide and magnetite produce no volume expansion during reduction, but instead, the volume contracts when oxygen escapes as reduction proceeds. The result is that the expansion of ferric oxide is absorbed. Another reason is that the metallic iron originally present in the raw material powder and the metallic iron produced by reduction of ferrous oxide and magnetite tend to undergo transformation at high temperatures of 1100° C. and above, and produce a sintering reaction which creates a binding effect between the particles. When the expansion absorbing agent has a small particle size, it can be inserted between the other particles in the compact, especially ferric oxide particles. As a result, as the particles contract as the reduction reaction proceeds, allowing enlargement of the spaces between the particles, the effect facilitates absorption of the ferric oxide expansion. The aforementioned binder effect of metallic iron is also effective since it allows other particles to be inserted between the particles.

The present inventors demonstrated that the effect is considerable when the total ratio of metallic iron, ferrous oxide and magnetite as the expansion absorbing agent particle components is at least 65%, and that the effect is also considerable when the particle size is 10 $\mu$M or smaller. It was discovered that addition of such particles lowers the porosity limit at which no powderization occurs (suitable porosity 2), for the same ferric oxide mixing ratio. The suitable porosity 2 under these conditions is shown in FIG. 2. The relationship is represented by the following formula <5>.

$$V2=0.5R-14 \quad <5>$$

Here, V2 is the suitable porosity 2 (%), and R is the ferric oxide content in the compact (mass %). In particular, as the porosity is 40% or greater with a compact produced using an extrusion-type molding apparatus, no problem of powderization of the compact occurs during reduction, regardless of the mixing proportion of the ferric oxide.

Figure 7:
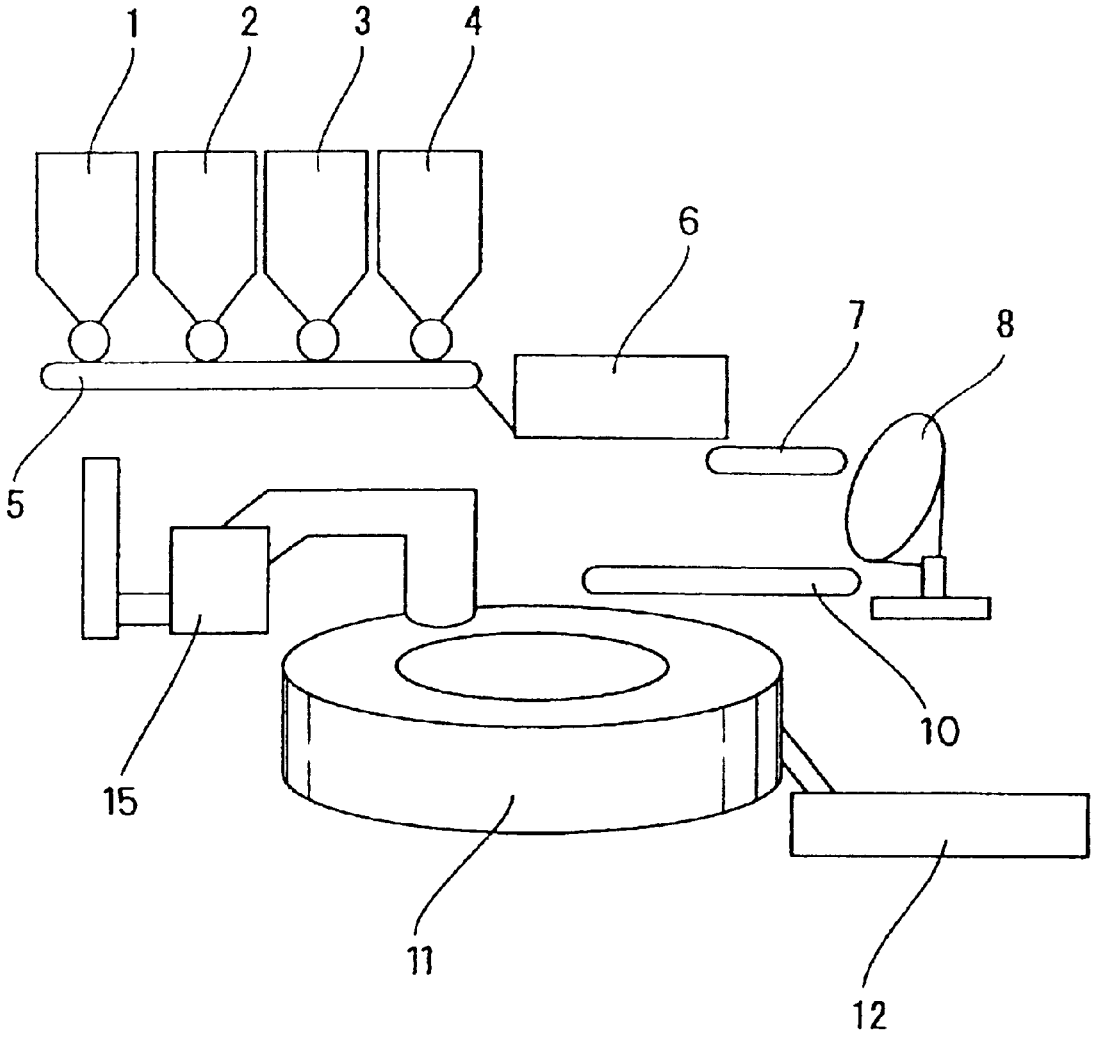
FIG. 7 is a schematic view of another example of the entire process including a rotary hearth-type reducing furnace used to carry out the invention.

Reduction treatment of an iron oxide-containing compact by the method of the invention will now be explained. An apparatus used for an operation according to the invention is shown in FIG. 7. The apparatus in FIG. 7 consists primarily of an ore raw material tank 1, a coke powder tank 2, an additional powder tank 3, a powder addition tank 4, a mixing apparatus 6, a compactor 8, a rotary hearth-type reducing furnace 11, an exhaust gas treatment apparatus 15 and a reduced iron compact cooling apparatus 12.

Iron oxide-containing powder which comprises ferric oxide powder is stockpiled in the ore raw material tank 1. The coke powder as a reducing agent is stockpiled in the coke powder tank 2. When a plurality of types of iron oxide-containing powder are to be used, an additional tank may be provided, such as the additional powder tank 3 in FIG. 7. A prescribed amount of powder is supplied from the ore raw material tank 1 and coke powder tank 2 and fed into the mixing apparatus 6 with a powder conveyer 5 where it is uniformly mixed to prepare the raw material powder. When there is added to this raw material powder an additional powder with a size of no greater than 10 $\mu$m and containing at least 65 mass % metallic iron, ferrous oxide and magnetite (hereinafter referred to as "fine particle additive"), the powder is supplied from the powder addition tank 4 and mixed in the mixing apparatus 6 at a prescribed mixing proportion of at least 10 mass %, to prepare the starting mixture.

The raw material powder or starting mixture prepared here is fed to the compactor 8 by a mixture conveyer 7 and used to form a compact. The compactor used may be a pan-type granulator, a roll compression-type briquette molding machine, or an extrusion-type molding machine which extrudes the moisture-containing raw material powder or starting mixture from a perforated die. FIG. 7 shows a pan-type granulator. The molding was carried out with a target porosity set so that the porosity of the compact was a value larger than V1 as the suitable value calculated based on the ferric oxide mixing ratio. Also, when the operation included mixing of a fine particle additive, the molding was carried out with the compact porosity set to a value larger than V2.

A pan-type granulator is preferred if the porosity target is below 30%, a briquette molding machine is preferred if the target porosity is 30–40%, and an extrusion-type molding machine is preferred if the target porosity is greater than 40%.

After completion of the molding, the compact is fed by a compact conveyer 10 into the rotary hearth-type reducing furnace 11 as the charging material. At the rotary hearth-type reducing furnace 11, heating is conducted in a gas atmosphere at a high temperature exceeding 1100° C., and usually about 1300° C., as the maximum temperature, and the iron oxide is reduced using the carbon in the compact as the reducing agent. The reduction time is 5–20 minutes, and the reduction yields a reduced iron compact (reduced product). During the reduction, expansion of the ferric oxide causes powderization of a part of the compact, producing a powdered reduced product. The powdered reduction product has a very low metallization rate with respect to the granulate reduced iron compact. According to the method of the invention, the generation of such powdered reduction product can be as low as 10% or less. A granulate reduction product (reduced iron compact) of satisfactory quality can therefore be inexpensively produced.

The proportion of oxygen compounded with easily reducible metal oxides such as iron oxide (referred to as active oxygen) and carbon in the compact is important. The ratio of (atomic moles of carbon)/(atomic moles of active oxygen) (atomic molar ratio) is referred to as the carbon equivalent ratio, and the effect of this value on the reaction was considered. If the carbon is too scarce, reduction does not proceed adequately. Under reduction conditions in a rotary hearth-type reducing furnace, the main reaction is, for example, $FeO + C \rightarrow Fe + CO$, in which carbon is oxidized to carbon monoxide. A portion of the carbon is oxidized to carbon dioxide by the reaction $FeO + \frac{1}{2}C \rightarrow Fe + \frac{1}{2}CO_2$. However, a portion of the carbon is consumed by reaction with the water vapor and carbon dioxide constituting the atmospheric gas in the furnace. The present inventors experimented with reaction in an actual rotary hearth-type reduction furnace with a reduction zone gas temperature of 1200–1350° C., for a reduction time of 10–17 minutes, and found that when the carbon equivalent ratio is 0.7 or below, the metallic iron proportion of the reduction product is below 75%. Consequently, the product value was lowered and the strength of the reduction product was poor. On the other hand, when the carbon equivalent ratio exceeded 1.5, the reduction rate of the compact was satisfactory but unreacted carbon remained in the reduction product, thereby inhibiting bonding of the metal in the reduction product and resulting in lower reduction product strength. According to the present invention, therefore, the carbon equivalent ratio is preferably between 0.5 and 1.5, and more preferably 0.7–1.4.

The reduction product is discharged from the furnace with a screw-type discharger (not shown), cooled at a reduced iron compact cooling apparatus 12 and transported to a reduced iron utilization process including a blast furnace, converter, electric furnace, etc. where it is made into a steel product. The off-gas accompanying combustion is cooled and collected at an off-gas treatment apparatus 15, and then released into the air.

EXAMPLES

Example 1

This example demonstrates the results of an operation using the rotary hearth-type reducing furnace shown in FIG. 1. This apparatus produces reduced iron pellets for a blast furnace at a rate of 15 ton/hour.

The raw material powder was a mixture of fine iron ore powder (pellet feed), converter gas dust and coke powder, having a total iron proportion of 54 mass %, a carbon proportion of 14 mass % and a carbon/active oxygen atomic molar ratio of 1.05. The mixture was molded into a compact with a porosity of 23% using a compactor (pan-type granulator) 8. The mean diameter of the compact was 13 mm (volume: 1150 mm3). After drying to a moisture content of 1 mass %, the compact was heated in the heating zone of the rotary hearth-type reducing furnace 11, and then subjected to reduction for 10 minutes at a mean gas temperature of 1370° C. in the reduction zone. The number of spread layers of the compact was 1.4. The obtained reduced iron pellets were cooled with a rotary cooler. The minimum heating time calculated for these operating conditions was 5.4 minutes, and the reduction time was within 1–3 times the minimum heating time.

The reduced iron pellets obtained by this operation had a apparent specific density of 3.1 g/cm$^3$ and a crushing strength of $9.5 \times 10^6$ N/m$^2$. This was approximately twice the minimum strength for use in a blast furnace, and therefore after mixture with other iron ore or sintered ore, a blast furnace was used to produce hot metal.

Comparative Example 1

Separately, the same compact as in Example 1 was subjected to reduction at 1370° C. for 4.3 minutes as an operation carried out for comparison. The crushing strength of the reduced iron pellets was $3.7\times10^6$ N/m$^2$. This did not satisfy the minimum strength for use in a blast furnace.

Examples 2–5

The following are the results of operation of a rotary hearth-type reducing furnace for Examples 2 to 5, using basically the basic apparatus shown in FIG. 7 according to the method of the invention. The results of reducing compacts molded by three different molding methods according to the present invention are shown in Table 1. Example 2 is an example of operation for reduction of a compact with a ferric oxide proportion of 55 mass % and a porosity of 24%, using a pan-type granulator. Example 3 is an example of operation for reduction of a compact with a ferric oxide content of 63 mass % and a porosity of 30%, produced with a briquette molding machine. Example 4 is an example of an operation for reduction of a cylindrical compact with a ferric oxide content of 82 mass % and a porosity of 43%, produced using an extrusion molding machine. Example 5 is an example of operation for reduction of a compact prepared by using a pan-type granulator to mold a raw material mixture comprising 75 mass % ferric oxide, a total of 71 mass % metallic iron, ferrous oxide and magnetite content, and 11 mass % of converter dust with a mean particle diameter of 2.9 $\mu$m.

The operating conditions in the rotary hearth-type reducing furnace were consistently a reduction temperature of 1285° C. and a reduction time of 12 minutes. The molar ratio of carbon to oxygen chemically combined with oxides in the compact was approximately consistent at 1.03–1.1. The compacts which were reduced were all dried with a compact drying apparatus.

In Example 2, the porosity was higher than the value of 18% calculated as the suitable porosity V1 from the ferrous oxide proportion. As a result, the powderization rate of the compact during reduction was 6.9%, and the average metallization rate of the reduced iron compact and powdered reduction product was high at 83%. In Example 3, the porosity was a high value of 30%, higher than the value of 23% calculated as the suitable porosity V1 from the ferrous oxide proportion. As a result, the powderization rate of the compact during reduction was 5.8%, and the average metallization rate of the reduced iron compact and powdered reduction product was high at 85%. The compact of Example 4 had a very high porosity of 43%, while the ferric oxide proportion was 82 mass % and the powderization of the compact was very low at 3.3%, even with a suitable porosity V1 value of 33%. The metallization rate of the compact was very satisfactory at 87%.

Example 5 is an example of operation using converter dust with a specific mean particle diameter for a ferric oxide expansion absorbing effect. The ferric oxide proportion was 75 mass %, the suitable porosity V2 calculated from the ferric oxide proportion was a low value of 24%, and the actual porosity was a high, though lower, actual porosity of 27%, such that no powderization occurred. The metallization rate was also high.

Comparative Example 2

Comparative Example 2 is an example of operation using the apparatus in FIG. 7 but without the conditions of the present invention, as shown in Table 1. The operation consisted of reduction of a compact with a ferric oxide proportion of 72 mass % and a porosity of 24%, using a pan-type granulator. The actual porosity of the compact was lower than 28% as the suitable porosity V1 calculated from the ferric oxide proportion. When the compact was treated under the same conditions as in the Examples, the powderization rate was as high as 15.6%, with minimal granulate product (reduced compact). Because of the low powdered reduction product reduction rate, the overall average metallization rate was at a low level of 71%.

TABLE 1

| Molding method | Example 2 Pan-type granulator | Example 3 Briquette molding | Example 4 Extrusion molding | Example 5 Pan-type granulator | Comp. Ex.2 Pan-type granulator |
|---|---|---|---|---|---|
| Actual porosity (%) | 24 | 30 | 43 | 27 | 24 |
| Ferric oxide proportion (mass %) | 55 | 63 | 82 | 75 | 72 |
| Suitable porosity (%) | 18 | 23 | 33 | 24 | 28 |
| Powderization rate (%) | 6.9 | 5.8 | 3.3 | 3.6 | 15.6 |
| Product metallization rate (%) | 83 | 85 | 87 | 86 | 71 |

INDUSTRIAL APPLICABILITY

According to the method of the present invention, it is possible to efficiently obtain reduced iron compacts (reduced iron pellets) with high crushing strength in a rotary hearth-type reducing furnace, and to efficiently reduce ferric oxide-containing iron oxide raw materials to produce reduced iron compacts with low powder and high reduction rates. The reduced iron compacts (reduced iron pellets) are characterized by their ability to be directly used in blast furnaces for production of hot metal, and to withstand transport over long distances.

We claim:

1. A method of producing a reduced iron compact in a rotary hearth reducing furnace, characterized by producing a compact with a porosity of 20–33% using a raw material powder wherein the total iron content is at least 40 mass % and wherein, among the included elements, the atomic molar ratio of carbon to oxygen chemically combined with iron and one or more members selected from the group consisting of manganese, nickel, zinc and lead is in the range of 0.5–1.5, putting said compact on the hearth of a reducing furnace equipped with a rotating hearth, and heating it for heating reduction by the heat from the combustion gas in the upper part of the furnace, such that the time of exposure to the gas atmosphere at 1200° C. or above is 1.0–3.0 times the minimum heating time (Ta) represented by formula <2> below and the maximum temperature of the gas in the furnace is no higher than 1400° C., $$Ta=0.045\ \exp(7100/T)+0.12V_p^{1/3} \quad <2>$$

Ta: minimum heating time (min)

T: mean gas temperature in furnace zone above 1200° C. (K)

$V_p$: Mean volume of compact (mm$^3$).

2. A method of producing a reduced iron compact in a rotary hearth reducing furnace, characterized by producing a compact with a porosity of>33 and≦55% using a raw material powder wherein the total iron content is at least 40 mass % and wherein, among the included elements, the atomic molar ratio of carbon to oxygen chemically combined with iron and one or more members selected from the group consisting of manganese, nickel, zinc and lead is in the range of 0.5–1.5, putting said compact on the hearth of a reducing furnace equipped with a rotating hearth, and heating it for heating reduction by the heat from the combustion gas in the upper part of the furnace, such that the time of exposure to the gas atmosphere at 1200° C. or above is 1.0–3.0 times the minimum heating time (Tb) represented by formula <3> below and the maximum temperature of the gas in the furnace is no higher than 1400° C., $$Tb=0.05\ \exp(7100/T)+0.14V_p^{1/3} \quad <3>$$

Tb: minimum heating time (min)

T: mean gas temperature in furnace zone above 1200° C. (K)

$V_p$: Mean volume of compact ($mm^3$).

3. A method of producing a reduced iron compact in a rotary hearth reducing furnace according to claim 1 or 2, characterized in that the volume of said compact is 100–14, 000 $mm^3$.

4. A method of producing a reduced iron compact in a rotary hearth reducing furnace according to claim 1 or 2, characterized in that the total mass of silicon oxide, aluminum oxide, calcium oxide, magnesium oxide and phosphorus oxide in said compact is no greater than 30% of the mass of the compact.

5. A method of producing a reduced iron compact in a rotary hearth reducing furnace according to claim 1 or 2, characterized in that said heating reduction is carried out with an average number of no more than 2 laminated layers when the compact is put on the hearth of the reducing furnace equipped with a rotating hearth.

6. A method of producing a reduced iron compact in a rotary hearth reducing furnace, characterized by producing a raw material powder comprising a mixture of iron oxide-containing powder and carbon-containing powder into a compact with a porosity which is at least the suitable porosity V1 represented by formula <4> below, putting said compact on the hearth of a reducing furnace equipped with a rotating hearth, and heating it for heating reduction at a temperature of 1100° C. or higher by the heat from the combustion gas in the upper part of the furnace, $$V1=0.55R-12 \quad <4>$$

where R is the mass ratio of ferric oxide in the compact and V1 is the suitable porosity of the compact.

7. A method of producing a reduced iron compact in a rotary hearth reducing furnace, characterized by producing a raw material powder comprising a mixture of iron oxide-containing powder and carbon-containing powder blended with at least 10 mass % of a powder having a mean particle size of no greater than 10 μm and comprising a total of at least 65 mass % of one or more from among metallic iron, ferrous oxide and magnetite, into a compact with a porosity which is at least the suitable porosity V2 represented by formula <5> below, putting said compact on the hearth of a reducing furnace equipped with a rotating hearth, and heating it for heating reduction at a temperature of 1100° C. or higher by the heat from the combustion gas in the upper part of the furnace, $$V2=0.5R-14 \quad <5>$$

where R is the mass ratio of ferric oxide in the compact and V2 is the suitable porosity of the compact.

8. A method of producing a reduced iron compact in a rotary hearth reducing furnace, characterized by producing a raw material powder comprising a mixture of iron oxide-containing powder and carbon-containing powder with a ferric oxide content of no greater than 85 mass %, into a compact with a porosity of at least 40%, putting said compact on the hearth of a reducing furnace equipped with a rotating hearth, and heating it for heating reduction at a temperature of 1100° C. or higher by the heat from the combustion gas in the upper part of the furnace.

9. A method of producing a reduced iron compact in a rotary hearth reducing furnace, characterized by producing a raw material powder comprising a mixture of iron oxide-containing powder and carbon-containing powder blended with at least 10 mass % of a powder having a mean particle size of no greater than 10 μm and comprising a total of at least 65 mass % of one or more from among metallic iron, ferrous oxide and magnetite, into a compact with a porosity of at least 40%, putting said compact on the hearth of a reducing furnace equipped with a rotating hearth, and heating it for heating reduction at a temperature of 1100° C. or higher by the heat from the combustion gas in the upper part of the furnace.

10. A method of producing a reduced iron compact in a rotary hearth reducing furnace according to claim 8 or 9, characterized in that the compact is produced by extruding the moisture-containing raw material powder or raw material mixture from a perforated die set against a metallic plate using an extruding roller, or by using a screw-type extruder in a metal casing for extrusion from a perforated die at an end plate set to one side of said metal casing.

11. A method of producing a reduced iron compact in a rotary hearth reducing furnace according to claim 7or 9, characterized in that dust with a mean particle size of 10 μm collected by a converter gas recovery apparatus is used as the powder having a mean particle size of no greater than 10 μm and comprising a total of at least 65 mass % of one or more from among metallic iron, ferrous oxide and magnetite.

12. A method of producing a reduced iron compact in a rotary hearth reducing furnace according to any one of claims 6 to 9, characterized in that the atomic mole of carbon in said compact is 0.5–1.5 times with respect to the atomic mole of oxygen chemically combined with oxides reduced in a reducing atmosphere at 1300° C.

* * * * *